US005325962A

United States Patent [19]

Ouellette

[11] Patent Number: 5,325,962

[45] Date of Patent: Jul. 5, 1994

[54] COMBINED LID AND TRAY ATTACHMENT

[76] Inventor: Angela R. N. Ouellette, 4601 NW. 2nd Ave., #804, Boca Raton, Fla. 33432

[21] Appl. No.: 144,000

[22] Filed: Nov. 1, 1993

Related U.S. Application Data

[63] Continuation-in-part of Ser. No. 937,531, Aug. 28, 1992, abandoned, which is a continuation-in-part of Ser. No. 829,711, Feb. 27, 1992, abandoned.

[51] Int. Cl.[5] ..... B65D 45/00

[52] U.S. Cl. ..... 206/229; 206/15.2; 206/216; 220/52.1

[58] Field of Search ..... 206/216, 576, 229, 204, 206/361, 15.2; 220/212, 521, 523, 526, 258; 215/228

[56] References Cited

U.S. PATENT DOCUMENTS

| | | | |
|---|---|---|---|
| 371,025 | 10/1887 | Bertram | 220/521 X |
| 881,889 | 3/1908 | Baker | 220/521 |
| 1,373,622 | 4/1921 | Lloyd | 220/521 X |
| 1,918,243 | 7/1933 | Bergaud | 220/521 X |
| 2,549,404 | 4/1951 | Williams | 220/521 X |
| 2,766,796 | 1/1956 | Tupper | 220/521 |
| 2,979,193 | 4/1961 | Fredette | 206/216 |
| 3,078,005 | 2/1963 | Lewerth | 220/212 X |
| 3,079,022 | 2/1963 | Tompkins | 220/521 X |
| 3,446,386 | 5/1969 | Wellington | 220/521 X |
| 4,300,700 | 11/1981 | Chang | 220/521 X |
| 4,667,484 | 5/1987 | Tarozzi et al. | 220/521 X |
| 4,978,022 | 12/1990 | Weick | 220/521 |
| 5,027,972 | 7/1991 | Bartholomew | 220/526 |
| 5,123,558 | 6/1992 | Moloney | 220/212 |
| 5,145,060 | 9/1992 | Maye | 206/44 R |

FOREIGN PATENT DOCUMENTS

| | | | |
|---|---|---|---|
| 489180 | 7/1938 | United Kingdom | 220/212 |

*Primary Examiner*—Jacob K. Ackun, Jr.
*Attorney, Agent, or Firm*—Oltman and Flynn

[57] ABSTRACT

A combination lid and tray attachment comprising two integrally combined components; a tray section comprised of a bottom surface and sidewalls extending upwardly from the bottom surface, and a lid section pending from the aforementioned bottom surface, comprised of sidewalls and an interlocking projection, whereby the tray section and lid section together facilitate use wherein the lid removably secures by way of the interlocking projections to a container, enclosing its contents to prevent spillage and the tray section provides a means for holding or storing desired articles.

1 Claim, 2 Drawing Sheets

COMBINED LID AND TRAY ATTACHMENT

"This application is a continuation-in-part of Ser. No. 07/937,531 filed on Aug. 28, 1992 and now abandoned, which is in turn a continuation-in-part of Ser. No. 07/829,711 filed on Feb. 27, 1992 and now abandoned."

BACKGROUND OF THE INVENTION

1. Field of the Invention

This invention relates generally to a combination lid and tray apparatus designed for attaching to containers. On the one hand, the invention acts as a cover for enclosing and sealing the contents of the container to prevent spillage, and on the other hand, it acts as a storage receptacle to hold or store articles which may be used in conjunction with the contents of the container.

2. Description of the Prior Art

Storing cleansing agents, like Ajax TM and Comet TM, and related products, such as sponges, scouring pads and soap pads, in an organized fashion is widely known to be burdensome and unsightly. Moreover, once cleansers and cleaning tools have been used, it becomes even more difficult to maintain an aesthetically pleasing cabinet or storage facility. Of course, the problem is not limited to cleaning products, but to other containers as well.

The foregoing problems have not been confronted by the prior art, however, there are some related structures presently known. One such structure is the custodial unit disclosed in U.S. Pat. No. 3,446,386, issued to Wellington. The Wellington patent describes a portable custodial service unit which is transported on a custodial cart. The custodial unit comprises a trash receptacle with a mountable tray for depositing trash and carrying supplies while cleaning a room. Although the invention is suitable as a trash receptacle and custodial tray, the custodial unit does not address the problem of providing a simple lid and tray for covering commercial cleanser containers to prevent spillage and for holding cleansing articles.

Another structure, disclosed in U.S. Pat. No. 1,373,622, issued to Lloyd, comprises a box having a cover with a dovetail groove for attaching a brush. In particular, the Lloyd invention relates to a shoe polish box whereby a brush may be readily attached to its cover. Obviously, this invention is limited in scope in that it is only convenient for brush attachments, as evidenced by the dovetail groove, and it would not be suitable, nor is it intended to be, for holding or storing cleaning articles and for covering cleanser containers.

The Fredette invention, disclosed in U.S. Pat. No. 2,979,193, is directed to a merchandising package, wherein an inverted, transparent, snap-on cup is attached to the top of a container and includes an article that is visible to the prospective purchaser to promote the sale of the main product being sold in the package. The snap-on cup could not be effectively used as a permanent storage receptacle for cleansers because its purpose is for merchandising; its use is only temporary. The snap-on cup is made from fragile plastic, and it is disposable with each purchase. Furthermore, the device is impractical for holding or storage purposes. Regular household sponges and other items can not fit under the cap; wet scouring sponges and steel wool would clog holes in cleanser-style containers, and wet sponges and pads would have a reduced life because they would not be exposed to the air for drying.

While the foregoing structures disclose various designs geared toward specific solutions, none of them solves the immediate problems previously mentioned. The present invention overcomes the aforementioned shortcomings by providing a combined lid and tray attachment that comprises a removable securing lid for cleanser containers and a holding tray that separates the cleansing products from the cleanser container.

SUMMARY OF THE INVENTION

The present invention provides a combined lid and tray attachment for covering containers and holding articles associated with the contents of said container. The invention is best described in two sections, wherein both sections are integrally combined. The first section, or "tray" section, comprises a bottom surface having sidewalls extending upwardly from the periphery of the bottom surface. The second section, or "lid" section, comprises an adapter pending from the bottom surface for attachment to containers. Disposed along the interior wall of this adapter is a locking projection which removably secures the lid.

The tray section, when viewed normal, may define either a rectangular section or an elliptical section. Likewise, from a normal perspective, the lid section defines either a rectangular section or an elliptical section. In a preferred embodiment, the lid section is elliptical and the tray section is rectangular, but the apparatus is not limited in scope to these geometric designs. The invention is versatile in its alternative embodiments in that the tray section and lid section may both form rectangular sections or elliptical sections, or combinations thereof.

The utilization of the present invention is elementary. In a first position, the combined lid and tray attachment is separate from the container. In a second position, it is attached, whereby the user merely takes the combined lid and tray attachment and mates the lid section with an appropriate container causing the lid section to snap onto the rim of the container by way of the interlocking projections. This forms a tight secured fit. In the event the container should fall while the structure is attached, spillage will be prevented. In a similar manner, the attachment is easily removed from the container by pulling the attachment and the container apart, thus returning to the first position. Articles such as sponges, pads, soap or any item of choice, within reason, may be placed in the tray by the user for holding or storing, whether the apparatus is in the first or second position.

This is a combination, Lid/Tray invention, designed to accommodate the standard cleanser can, i.e. AJAX ®, BABO ®, COMET ®. All of these cleanser containers are of uniform size in circumferential dimension of 9.25". The lid portion of the invention is made not specifically as a "cover", but as a means of attaching the tray-receptacle to the cleanser can as an accessory to accommodate a flat sponge, specifically the SCOTCH- BRITE ® sponge which should be allowed to remain flat in an open container, exposed to air for drying purposes, and for the necessity of keeping the sponge flat for its continued use in the fashion for which it was intended. It is necessary for this sponge to remain flat as it consists of a double facing comprised of one side sponge and the reverse side of abrasive plastic. The abrasive plastic side, when used for scouring, should be kept flat so as to cover as much scouring surface as possible, and yet small enough in size to fit comfortable in the hand. The sponge side also requires the need to remain flat so as to allow its full surface for more, or greater absorption.

Since this scouring sponge is a likely tool for use with the cleanser, and one most commonly used, the tray portion is designed to accommodate the sponge so that it will remain in its original shape to generate its full use.

Since steel wool pads are also used in conjunction with the cleanser, as a souring tool, the tray portion may change its shape from rectangular to oval to round or star shape for accommodating such a scouring tool. While this is the case, the lid portion will always remain constant in its dimensions in accommodating the cleanser can. Therefore, where the lid portion will always remain the same size and shape, the tray portion may easily vary without affect to the lid.

The lid/tray combination is an article that will be used repeatedly, with every subsequent can of cleanser. It will not be discarded with the empty can be retained for use with each new can. It should be regarded as an accessory to the cleanser can for accommodation the particular tool to be used in scouring or cleaning. Since all household cleanser containers are of stand size, diametrically, each equal to the other, the lid/tray combination will fit any brand of cleanser for the length of the life of the lid/tray attachment. Its life expectancy should range 2 to 3 years, or possibly more, since it will be made of a durable plastic polyurethane or rubber. It will not be expected to crack or break under ordinary use, allowing for an ideal storage location of the companion tool. The tool, be it sponge or steel wool soap pad, will then have a specific storing area where none has existed before. Previously the homemaker has had to resort to make-shift storage containers of the once-used tools, knowing the tool will be used many times more before discarding. The lid/tray combination now allows for a specific storage area which is handy, neat and compact, making for a neater, cleaner more organized cupboard. The cupboard now has more room for storage since previously the make-shift container sat beside the cleanser can, now it sits in the tray atop the cleanser can. The tray is an always open compartment so the wet sponge is free to lie flat and undisturbed for any length of time, ready for use at a moments notice, and allowed to dry between uses without causing damage to the cupboard floor, if that is where the sponge is usually placed.

The spaciousness of the tray allows for the accommodation of any sponge, steel wool pad, or any other similar sourcing device without having to cram or stuff the tool to fit. Such action would ruin the sponge, making further use of tis difficult, if not hopeless.

The tray may become easily enlarged in design without changing the existing diametric size of the lid, and may take on various shapes without any affect to the design or size of the lid.

Since the tray will accommodate either the aforementioned sponge or the steel wool soap pad, the lid/tray combination can be used with a cleanser can in the kitchen and in every bathroom as well. There will be no need to remove the tool from the kitchen cupboard and transport is to the bathroom for use there. Each area may have its own cleanser can with accompanying lid/tray attachment for handier use in each bathroom and kitchen, thereby eliminating the unsightliness of make-shift storage areas for these tools in any part of the house. Should the homemaker wish to transport only the lid/tray with a wet sponge to another area of the house such as the bathroom, this may be done without fear of wetting floor surfaces with an otherwise dripping sponge. Transport of both sponge and steel wool pad may be carried in the tray for use elsewhere.

In using the lid/tray attachment, one simply places the lid on the cleanser can in a snap-on fashion. It will fit snugly enough so as to prevent any cleanser spills should the can topple, yet loose enough for easy removal. Once removed, the tray portion will serve as a counter soap dish-like article where the sponge, steel wool pad, or a bar of soap may be placed during the process of cleaning, scouring or rinsing. This will allow for a neater cleaning area as no remaining residue from the cleaning process will remain to taint the surrounding counter area or cleaning area, since the tool will e placed back in the tray when not in use, as soap is placed back in the soap dish. This will save time as well, since there will be little after cleaning needed, whereas previously blue suds or even rust tinges remained with the placing of a used BRILLO® soap pad on the counter or sink area.

Should the homemaker find it necessary, the ray portion may be used, temporarily, to contain bleach or a liquid such as LESTOIL® in the cleaning process, in conjunction with he cleanser; or simply soapy water, depending on the cleaning chore. The homemake may opt to leave the tray in the cupboard and use an entirely different tool, but the tray will still serve as a storage area for the left-behind tool so that whether or not it is attached to the cleanser can the tray still serves as a storage compartment. It is a receptacle both on or off the cleanser can, with no distortion required for the tool.

Though some homemakers have been placing the tool on top of the perforated can surface, this practice has brought about the seepage of liquid into the cleanser can, thereby solidifying the once powdery contents. The holed surface of the cleanser can has also become clogged. With use of the lid/tray attachment, the separation provided between the tool and the perforated holes will no longer allow for seepage of any kind. The powdery contents will be thoroughly protected from outside intrusion and the homemaker will be able to use the total contents of the cleanser rather than having to discard a half used, solidified portion that has been rendered unusable.

Another added feature is in using the lid/tray upside down as a base platform on top of which is inserted the cleanser can as on a stage. While the can itself remains upright, this placement will allow for the stability of the can (in cases where the tray portion is larger than the lid), as well as serving as a protection from any undesirable surfaces on which the can may be placed, such as a lawn, for outdoor cleaning. The inverted tray now serves as a platform to render the cleanser topple-proof. Or it could be placed on a wet surface such as a wet driveway when washing a car. The paper can is now protected from water puddles. Since this invention can be utilized in reversal positions while still attached to the cleanser can, it should be considered unique.

With the placement of a separate cleanser can with the lid/tray attachment in every cleaning area, the homemaker will find its convenience time saving and more organized. Its one time cost will be repaid many items over through is use as a durable, retainable cap/storage compartment that should last a long time.

The lid/tray attachment, made of flexible plastic or rubber, is comprised of the following dimensions, specifically to conform to the diametric size and shape of the cleanser can:

The cylindrical cleanser can has a top end with an upper rim measuring 9.25 inches in circumference. The sponge cleaning tool measures 4.5 inches in length, 2.75 inches in width and 0.05 inches in depth.

Since the tray portion may vary in size and shape, it is capable of accommodating a variety of tools with little restriction. Its main purposes are:

1) to accommodate these tools in such a way as to prevent distortion of the tool.

2) for its handy convenience in conjunction with the cleanser can.

3) to allow for open air drying of the tool.

4) to provide a tray that may also be used to contain liquid, temporarily.

5) to allow for a proper storage area for a tool that will be used many times before discarding.

6) a means of keeping the powder contents dry and free of intrusion of liquid.

7) to provide a more orderly, more organized space saving cupboard area.

8) to serve as a topple-proof stand.

9) to serve as a soap dish.

But most important is the fact that it is made to be retained and not discarded. It is designed to be used and reused with each new can of cleanser, each different brand of cleaner, for the length of its life. It is designed for use with a specific container, rendering all other inventions similar in concept totally useless for this particular purpose.

Inventions cited previously, because of similarity of use, would have to be redesigned for compatibility with the particular cleanser can.

Where other cited inventions may show some similarities, their design requires both lid/receptacle and container (can). Whereas this invention consists only of the lid/tray attachment. This, plus the fact that it is retainable renders it totally unique for comparative use.

Simple in design, the lid/tray attachment requires no tracks for attachment, no screw-on device for attachment, no lock-in lip for sealing. It is easily applied in a snap-on fashion, and just as easily removed.

When used as a stand under the can, it may be placed on a wet surface without fear of water damage to the paper-like cleanser container, as the container has been raised above floor level, as on a platform.

This lid/tray attachment is designed to fit an existing cleanser container in the best possible fashion. No other cited invention is capable of doing this without having to alter its design in size or shape, or without having to alter the size and shape of the existing cleanser can in question.

In accordance with the present invention, it is an object thereof to provide a combined lid and tray attachment that simultaneously securedly attached to a container while providing a tray for holding articles associated with the contents of the container.

An additional object of the instant invention is to provide a combined lid and tray attachment which is simple in construction and operation.

Still an additional object of the instant invention is to provide a low cost combined lid and tray attachment for containers.

Another object of the instant invention is to provide a combined lid and tray attachment which is simple to use, yet effective.

Still an additional object of the instant invention is to provide a combined lid and tray attachment which may be easily cleaned.

A further object of the instant invention is to provide a combined lid and tray attachment which securedly attaches to a container to prevent spillage in the event the container topples.

Still a further object of the instant invention is to provide a combined lid and tray attachment which conserves space within a cabinet and improves the appearance of the cabinet.

Yet another object of the instant invention is to provide a combined lid and tray attachment which is reusable with subsequent containers.

A further object of the instant invention is to provide a means for combining, yet separating, wet and dry materials.

A still further object of the instant invention is to provide an easily accessible, open, receptacle storage area.

In accordance with these and other objects which will be apparent hereinafter, the instant invention will now be described with particular reference to the accompanying drawings.

DESCRIPTION OF THE PREFERRED EMBODIMENTS

Figure 1:
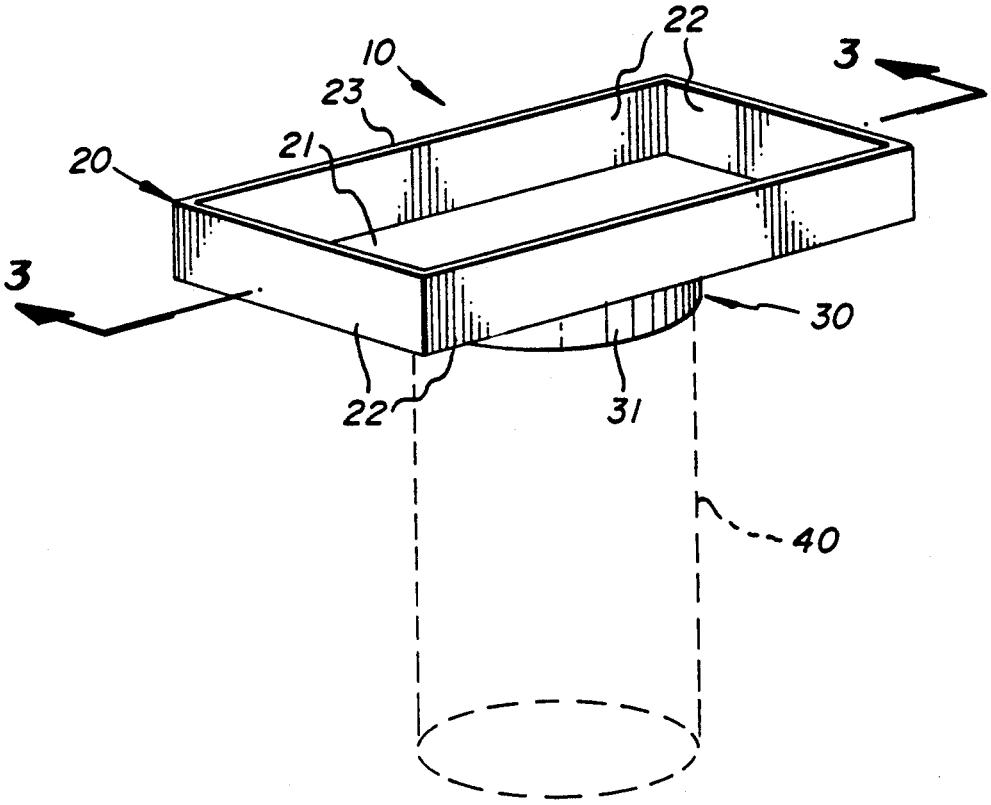
FIG. 1 is a perspective view of the preferred embodiment of the instant invention as attached to a container.

With reference to FIGS. 1–4, there is depicted a combination lid and tray attachment, generally characterized by the reference numeral 10, comprising two integrally combined components, a tray section 20 and a lid section 30. In this embodiment, the tray component 20 is a substantially rectangular open housing comprised of bottom surface 21 and sidewalls 22. Bottom surface 21 is integrally combined with sidewalls 22 wherein sidewalls 22 extend upwardly from bottom surface 21 having peripheral upper rim 23 to define an open top end, thereby forming a retaining receptacle.

In this embodiment, lid section 30 is substantially cylindrical or elliptical and acts as a cover or lid for container 40. Lid section 30 is comprised of the bottom of bottom surface 21 and sidewalls 31 pending from said bottom surface 21.

Figure 3:
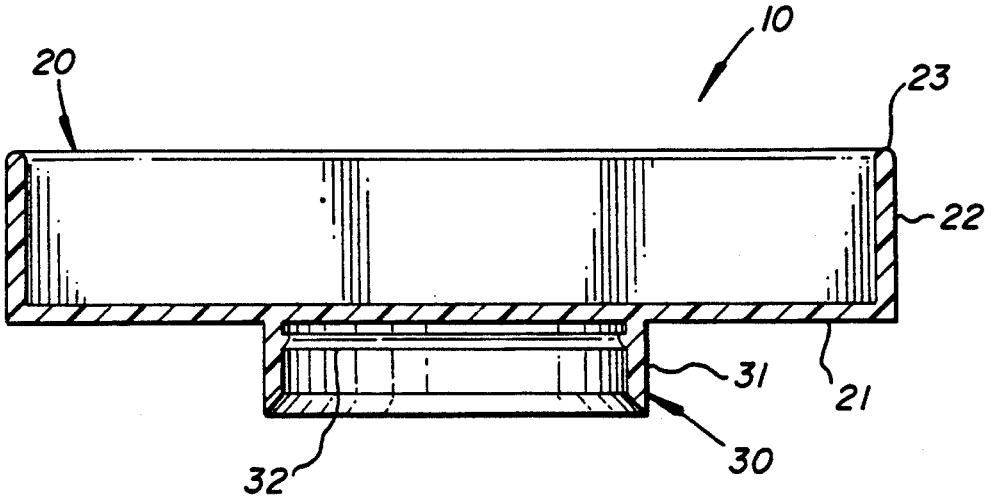
FIG. 3 is a cross sectional view of the preferred embodiment of the instant invention.

To utilize the instant invention, the apparatus 10, comprised of tray section 20 and lid section 30, are moved from a first position, wherein the invention is not attached to the container 40, into a second position, wherein the invention mates with the container 40 as seen in FIG. 1. Referring to FIG. 3, interlocking projection 32 engages with the rim of container 40 to securedly attach thereto. In a second position, the container 40 is securedly covered and articles may be placed in tray section 20 within the confines of sidewalls 22 for holding or storage. It is important to note that the present invention 10 may be utilized for holding or storage while in the first position and still fall within the scope of the invention.

The present invention 10 may be fabricated from hard plastic-like or rubber-like material. It is also important to note that the present invention 10 may be fabricated from rigid material other than plastic or rubber and still fall within the scope of the invention.

Figure 2:
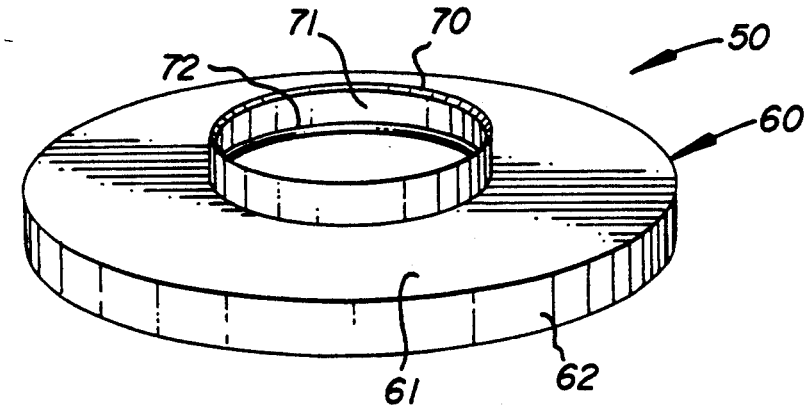
FIG. 2 is a bottom elevational view of the instant invention in an alternative embodiment.
Figure 4:
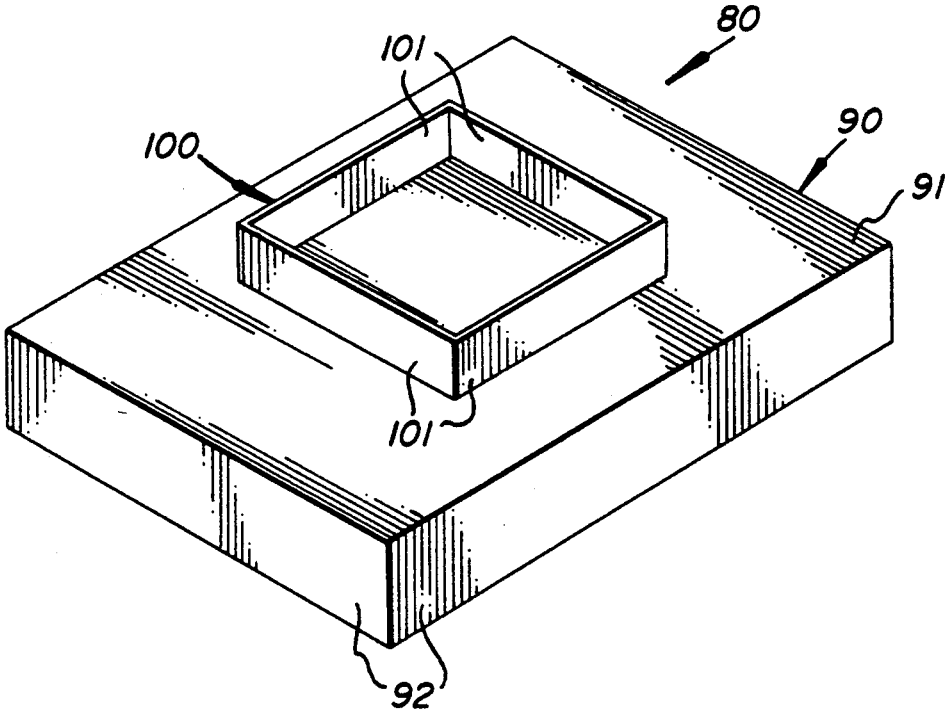
FIG. 4 is a bottom elevational view of an alternative embodiment of the instant invention.

In an alternative embodiment as seen in FIG. 2, tray section 60 is comprised of bottom surface 61 and sidewall 62, wherein sidewall 62 extends upwardly from bottom surface 61. Tray section 60 in this embodiment is substantially cylindrical or elliptical. Likewise, lid section 70, comprised of bottom surface 61, sidewall 71 and interlocking projection 72, is substantially cylindrical or elliptical. FIG. 4 displays another alternative embodiment, wherein tray section 90 is substantially rectangular and is comprised of bottom surface 91 and sidewalls 92 which extend upwardly from bottom surface 91. Likewise, lid section 100 is substantially rectangular and is comprised of bottom surface 91 and sidewalls 101.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A cleaning kit comprising:

a substantially rectangular shaped sponge measuring 4.5 inches in length by 2.75 inches in width by 0.5 inches in depth and having a first broad face comprising ordinary sponge material and a second broad face comprising an abrasive plastic material for scouring, said broad faces each having a broad face area defined by said length and width, a cylindrical cleanser can of conventional design having a top end and a bottom end, said top end having an upper rim measuring 9.25 inches in circumference and a bead protruding radially outward from said upper rim and a top wall with a plurality of cleanser dispensing perforations, a tray structure for receiving and retaining said sponge having a rectangular bottom wall having an area and a shape substantially matching those of one of said broad face areas of said sponge and having a substantially peripheral side wall extending upward from said bottom wall and having an open top for exposing said sponge to the atmosphere surrounding said tray structure to permit moisture to evaporate from said sponge, and a can engaging flange extending downward from said bottom wall for sliding over said can upper rim and having engaging means within said flange for receiving and engaging said bead to removably secure said tray structure to said can.

* * * * *

UNITED STATES PATENT AND TRADEMARK OFFICE

CERTIFICATE OF CORRECTION

PATENT NO. : 5,325,962

DATED : Jul 5,1994

INVENTOR(S) : Angela R.N.Ouellette

It is certified that error appears in the above-indentified patent and that said Letters Patent is hereby corrected as shown below:

| Col 3 | LINE | IS | SHOULD BE |
|---|---|---|---|
| | 1 | comfortable | comfortably |
| | 10 | souring | scouring |
| | 20 | can be | can but |
| | 22 | accommodation | accommodating |
| | 24 | stand size | standard size |
| | 35 | containers of | containers for the |
| | 51 | sourcing | scouring |
| | 53 | use of tis | use of it |
| | 63 | transport is | transport it |

| Col 4 | LINE | IS | SHOULD BE |
|---|---|---|---|
| | 16 | the tool will e | the tool will be |
| | 23 | the ray | the tray |
| | 26 | with he cleanser | with the cleanser |
| | 27 | The homemake | The homemaker |
| | 67 | items over | times over |

Signed and Sealed this

Twenty-eight Day of March, 1995

Bruce Lehman

*Attest:*

BRUCE LEHMAN

*Attesting Officer*

*Commissioner of Patents and Trademarks*